US009839273B2

(12) United States Patent
Nam

(10) Patent No.: US 9,839,273 B2
(45) Date of Patent: Dec. 12, 2017

(54) LOCKING DEVICE

(71) Applicant: GEUMDO HARDWARE LTD., Seoul (KR)

(72) Inventor: Gabno Nam, Guri-si (KR)

(73) Assignee: GEUMDO HARDWARE LTD., Seoul (KR)

( * ) Notice: Subject to any disclaimer, the term of this patent is extended or adjusted under 35 U.S.C. 154(b) by 0 days.

(21) Appl. No.: 15/396,727

(22) Filed: Jan. 2, 2017

(65) Prior Publication Data

US 2017/0202329 A1 Jul. 20, 2017

(30) Foreign Application Priority Data

Jan. 19, 2016 (KR) ..... 10-2016-0006384

(51) Int. Cl.
*A45C 13/10* (2006.01)
*B65D 33/16* (2006.01)

(52) U.S. Cl.
CPC ..... *A45C 13/10* (2013.01); *B65D 33/16* (2013.01)

(58) Field of Classification Search
CPC ..... A45C 13/10; A45C 12/12; B65D 33/16
See application file for complete search history.

(56) References Cited

U.S. PATENT DOCUMENTS 1,457,592 A * 6/1923 Murray ..... F16B 39/24 301/68
2,278,062 A * 3/1942 De Koharovich ..... F16B 39/24 411/144
8,245,371 B2 * 8/2012 Chen ..... A43C 7/00 24/68 B
8,832,912 B2 * 9/2014 Ha ..... A43C 11/165 24/68 B
9,101,181 B2 * 8/2015 Soderberg ..... A43C 11/165
2010/0139057 A1 * 6/2010 Soderberg ..... A43C 11/16 24/68 R
2011/0255219 A1 * 10/2011 Ou ..... F16M 11/10 361/679.01
2013/0101238 A1 * 4/2013 Han ..... F16K 15/144 383/66

FOREIGN PATENT DOCUMENTS

KR 1990-0006932 Y1 8/1990
KR 2002-0040182 A 5/2002
KR 10-0769748 B1 10/2007
KR 10-1583359 B1 1/2016

* cited by examiner

*Primary Examiner* — Robert Sandy
*Assistant Examiner* — David M Upchurch
(74) *Attorney, Agent, or Firm* — KORUS Patent, LLC; Seong Il Jeong

(57) ABSTRACT

There is provided a locking device including: a locking unit capable of performing locking and unlocking operations by rotation; an upper body part in which a first connection hole is formed; a body part which is inserted into the first connection hole of the upper body part and combined with one end of the locking unit; a lower body part in which a third connection hole into which the body part is inserted from below is formed; and a locking washer which is positioned between the upper body part and the lower body part and configured to fix and combine the upper body part and the lower body part.

7 Claims, 6 Drawing Sheets

(a)

(b)

LOCKING DEVICE

CROSS-REFERENCE TO RELATED APPLICATIONS

This application claims the priority of Korean Patent Application No. 10-2016-0006384 filed on Jan. 19, 2016, in the Korean Intellectual Property Office, the disclosure of which is incorporated herein by reference.

BACKGROUND

Field

The present disclosure relates to a locking device.

Description of the Related Art

In general, a bag has an inner space to accommodate goods therein and has an opening/closing structure in order for the goods accommodated therein not to escape from the bag. For example, the opening/closing structure of the bag is roughly classified into a locking device-type structure and a zipper-type structure. A one-touch type structure enables the bag to be opened and closed at a time and may include a separate locking device.

In a locking device-type structure currently used, an upper plate disposed on one side of a bag and a lower plate disposed on the opposite side are combined with fabric (e.g., leather) interposed therebetween. Conventionally, the upper plate and the lower plate have been screw-combined in order to strongly combine the upper plate and the lower plate or the upper plate and the lower plate has been combined and then riveted by pressurizing an insertion part protruded in a direction to be spread outwards in order to suppress separation therebetween.

However, the conventional screw-type locking device may be decreased in combination force due to wear caused by relative rotation of the upper and lower plates in use and thus may be separated. Further, the conventional rivet-type locking device requires a separate press or pressing process and thus has low workability and may be separated together with fabric interposed between the upper and lower plates due to wear of the fabric caused by relative rotation of the upper and lower plates in use.

Patent Document 1: Korean Utility Model Publication No. 1988-0006500 (May 31, 1988)

SUMMARY

Exemplary embodiments of the present disclosure relate to a locking device for bags, and provide the locking device of which an upper body part and a lower body part are fixed and combined with each other by a locking washer.

Further, the exemplary embodiments of the present disclosure provide a locking device for bags that enables a bag to be easily opened and closed.

However, problems to be solved by the present disclosure are not limited to the above-described problems. Although not described herein, other problems to be solved by the present disclosure can be clearly understood by those skilled in the art from the following descriptions.

A locking device according to an exemplary embodiment of the present disclosure may include: a locking unit capable of performing locking and unlocking operations by rotation; an upper body part in which a first connection hole is formed; a body part which is inserted into the first connection hole of the upper body part and combined with one end of the locking unit; a lower body part in which a third connection hole into which the body part is inserted from below is formed; and a locking washer which is positioned between the upper body part and the lower body part and configured to fix and combine the upper body part and the lower body part.

The upper body part may include a plurality of combination protrusions formed on a lower side of the upper body part.

The locking washer may include combination holes for combination with the combination protrusions at positions corresponding to the combination protrusions, respectively.

In the locking washer, a second connection hole may be formed, and a plurality of protrusions extended inwardly along an inner periphery of the second connection hole may be provided.

The number of the protrusions may include at least one of 12, 16, or 20.

The protrusions may be slanted upwardly or downwardly at a predetermined angle, and the protrusions may be forcibly inserted into the lower body part, and, thus, the upper body part and the lower body part can be fixed and combined with each other.

The angle may be from 25 degrees to 35 degrees.

The protrusion may have a cross section formed into a circular shape, a rectangular shape, or a polygonal shape.

The exemplary embodiments of the present disclosure provide a locking device that has a strong combination force due to a uniform force supplied by a locking washer.

Further, the exemplary embodiments of the present disclosure provide a locking device configured to enable a bag to be easily opened and closed.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Hereinafter, embodiments of the present disclosure will be described in detail with reference to the accompanying drawings. However, they are merely exemplary embodiments and the present disclosure is not limited thereto.

Detailed descriptions of functions or configurations known in the art may be omitted to avoid obscuring the subject matter of the present disclosure. Further, the terms used herein are defined in consideration of functions in the present disclosure, and may vary depending on intentions of a user or operator, or usual practices. Therefore, the definitions thereof should be construed based on the contents throughout the specification.

The technical concept of the present disclosure is defined by the claims. The following embodiments are used merely to efficiently explain the technical concept of the present disclosure to one of ordinary skilled in the art.

Figure 1:
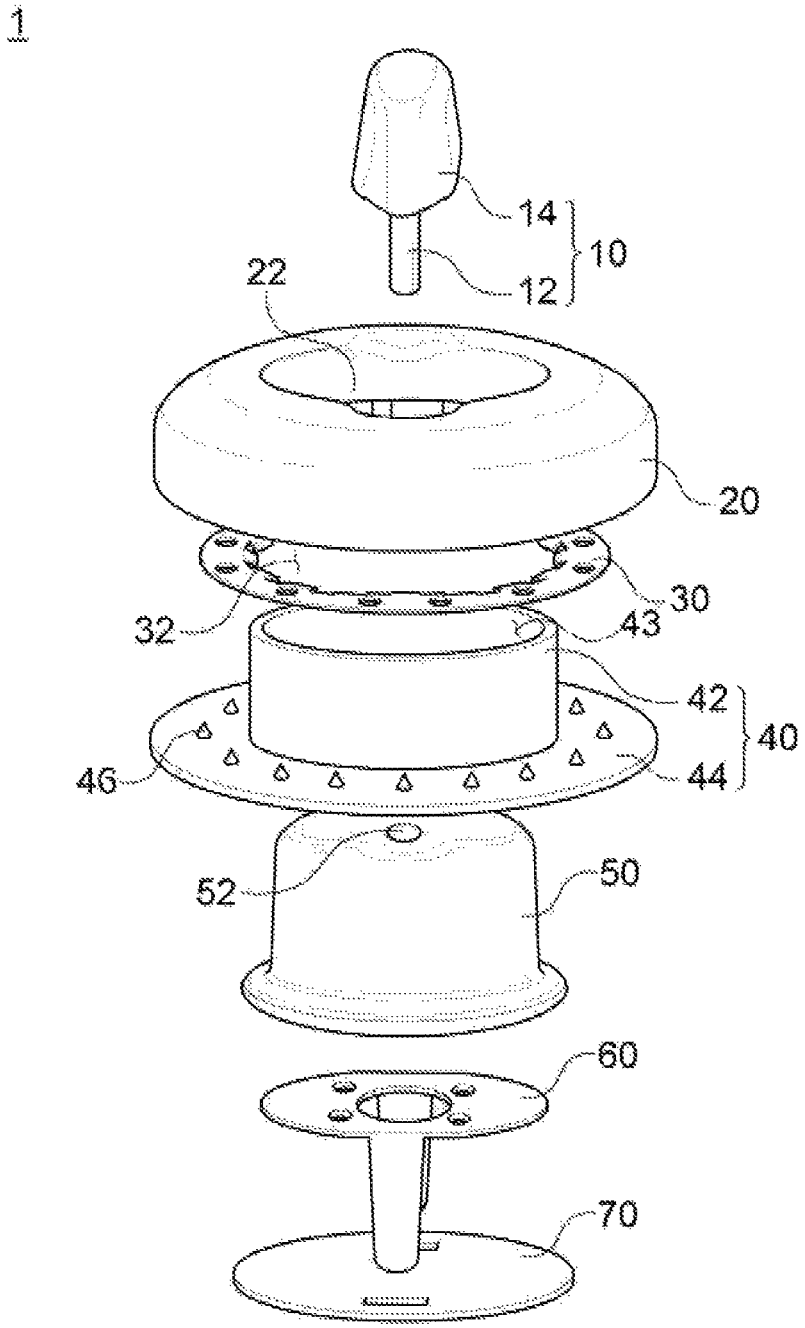
FIG. 1 is an exploded view of a locking device according to an exemplary embodiment of the present disclosure.
Figure 2:
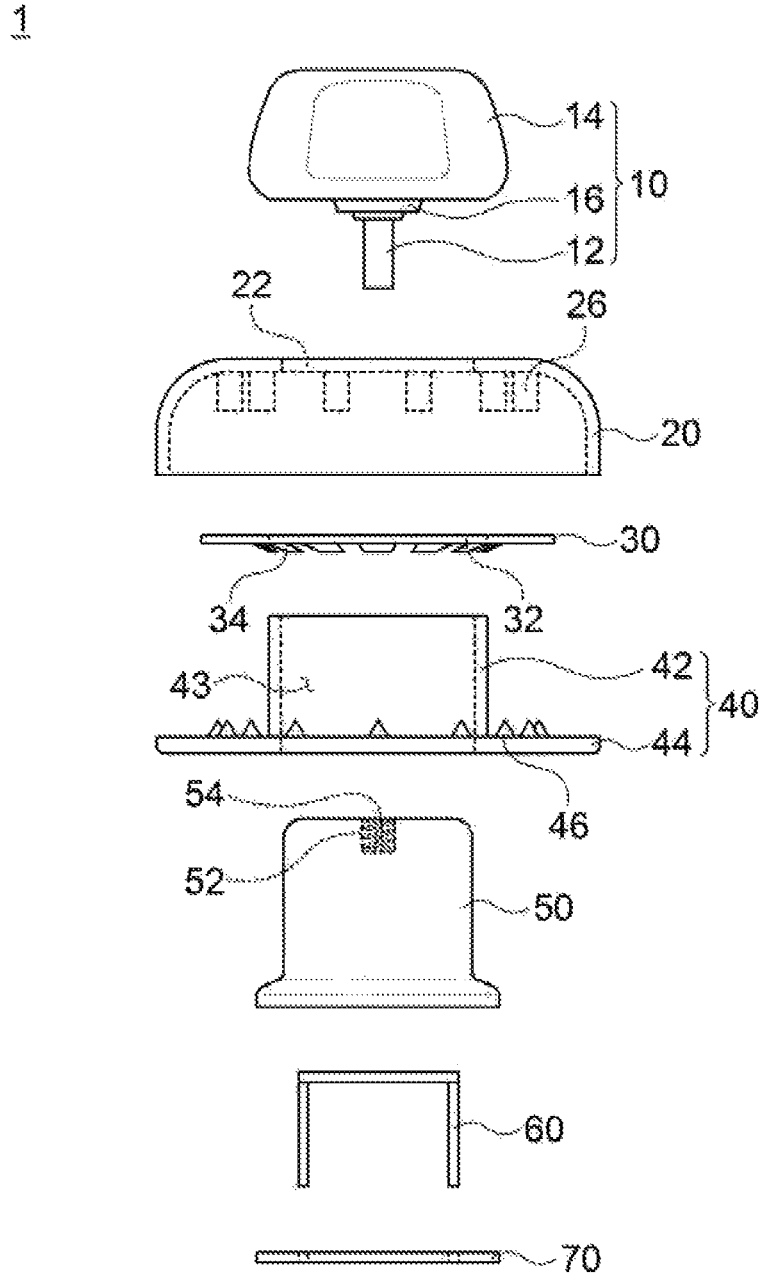
FIG. 2 is an exploded cross-sectional view of the locking device according to an exemplary embodiment of the present disclosure.

FIG. 1 is an exploded view of a locking device 1 according to an exemplary embodiment of the present disclosure. FIG. 2 is an exploded cross-sectional view of the locking device 1 according to an exemplary embodiment of the present disclosure. The locking device 1 according to an exemplary embodiment of the present disclosure is a locking device for opening/closing a bag or a purse.

Referring to FIG. 1 and FIG. 2, the locking device 1 may include a locking unit 10 capable of performing locking and unlocking operations by rotation, an upper body part 20 in which a first connection hole 22 is formed, a body part 50 which is inserted into the first connection hole 22 of the upper body part 20 and combined with one end of the locking unit 10, a lower body part 40 in which a third connection hole 43 into which the body part 50 is inserted from below is formed, a locking washer which is positioned between the upper body part 20 and the lower body part 40 and configured to fix and combine the upper body part 20 and the lower body part 40, a first supporting plate 60 supporting the body part 50, and a second supporting plate 70.

As illustrated in FIG. 1 and FIG. 2, the locking device 1 may be formed by combining the locking unit 10, the upper body part 20, the locking washer 30, the lower body part 40, the body part 50, the first supporting plate 60, and the second supporting plate 70 in order.

The locking unit 10 may include a locking unit rotating rod 12 and a locking unit rotating part 14. The locking unit rotating rod 12 may be inserted into the first connection hole 22 formed in the upper body part 20, and specifically, the locking unit rotating rod 12 may be inserted into a fourth connection hole 52 of the body part 50 via the first connection hole 22. That is, a place (first connection hole) for insertion of the locking unit rotating rod 12 may be different from a space (fourth connection hole) for maintaining the locking unit rotating rod 12 as being inserted. Therefore, the locking unit rotating rod 12 may be inserted into the fourth connection hole 52 and maintained as being inserted within the body part 50. In the body part 50 in which the fourth connection hole 52 is formed, an elastic member 54 that enables the locking unit rotating rod 12 to be rotated at a predetermined angle may be provided. For example, the elastic member 54 may adopt any member, such as a coil spring, a leaf spring, etc., which can give an elastic force. The locking unit rotating rod 12 can be rotated by the elastic member 54, and the locking device 1 can perform locking and unlocking operations with an elastic force of the elastic member 54.

The locking unit rotating part 14 that enables the locking unit rotating rod 12 to be rotated clockwise or counterclockwise may be provided. The locking unit rotating part 14 may be positioned orthogonal at 90 degrees to a longitudinal direction of the upper body part 20 when a locking operation is performed. The locking unit rotating part 14 may be positioned in the longitudinal direction of the upper body part 20 when an unlocking operation is performed. The locking unit rotating part 14 may be smaller in size than the upper body part 20. Specifically, the locking unit rotating part 14 may be formed so as to correspond in size and shape to the first connection hole 22. Further, the locking unit rotating part 14 may be formed into a shape that enables a user to easily perform the locking and unlocking operations. For example, the locking unit rotating part 14 may be formed into a cylindrical shape, a hexahedral shape, or the like with a predetermined thickness.

Further, a blocking part 16 may be formed at an end of the locking unit rotating rod 12 (where the locking unit rotating part 14 is positioned). A predetermined gap may be formed between the locking unit 10 and the upper body part 20 by the blocking part 16. When the locking unit rotating part 14 is repeatedly rotated, the locking unit rotating part 14 is repeatedly brought into contact with the upper body part 20. Thus, the gap is formed to suppress wear at a contact portion between the locking unit 10 and the upper body part 20. The blocking part 16 may be formed to have a greater diameter than the fourth connection hole 52 which is a space for maintaining the locking unit rotating rod 12 as being inserted, and may be formed to a smaller diameter than the first connection hole 22. Also, the blocking part 16 may block additional insertion of the locking unit rotating rod 12 toward the fourth connection hole 52.

Figure 3:
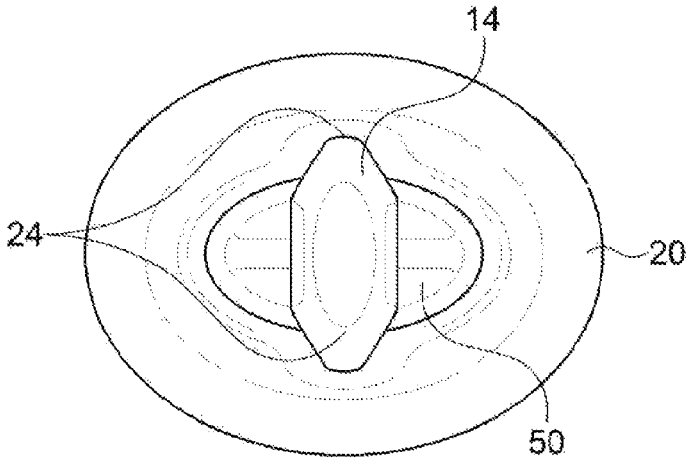
FIG. 3 is a front view of the locking device according to an exemplary embodiment of the present disclosure.

FIG. 3 is a front view of the locking device 1 according to an exemplary embodiment of the present disclosure. Referring to FIG. 1 to FIG. 3, the upper body part 20 may include the first connection hole 22, a stumbling sill 24, and a combination protrusion 26.

The upper body part 20 may have an open space therein, and the first connection hole 22 may be formed at the center thereof. The third connection hole 43 of the lower body part and the body part 50 may be inserted toward the first connection hole 22. The first connection hole 22 may have a cross section formed into an oval shape. The first connection hole 22 may also have a cross section formed into an asymmetric shape in order to improve the accuracy of combination position and suppress rotation when the upper body part 20, the locking washer 30, the lower body part 40, and the body part 50 are combined in order. Therefore, the upper body part 20, the locking washer 30, the lower body part 40, and the body part 50 can be combined and fixed to each other with accuracy. Further, a second connection hole 32 and the third connection hole 43 may be formed into a shape corresponding to a shape of the first connection hole 22.

Meanwhile, as illustrated in FIG. 3, the stumbling sill 24 may be formed on an outer peripheral surface of the upper body part 20. If the user rotates the locking unit rotating part 14 to perform a locking operation, the locking unit rotating part 14 is caught by the stumbling sill 24, so that the locking operation is performed. The stumbling sill 24 may be formed into a concave groove around an end of the locking unit rotating part 14 to suppress a deviation of the locking unit rotating part 14.

Further, as illustrated in FIG. 2, the upper body part may include a plurality of combination protrusions 26 formed on a lower side of the upper body part 20. The combination protrusions 26 may be inserted and combined with combination holes 36 of the locking washer 30 illustrated in FIG. 4. Therefore, the combination protrusions 26 may be formed into a column shape so as to be inserted and combined with combination holes 36.

FIG. 4A is a diagram illustrating a shape of the locking washer 30 according to an exemplary embodiment of the present disclosure. FIG. 4B is a diagram illustrating an angle of the protrusion 34 according to an exemplary embodiment of the present disclosure.

Figure 4:
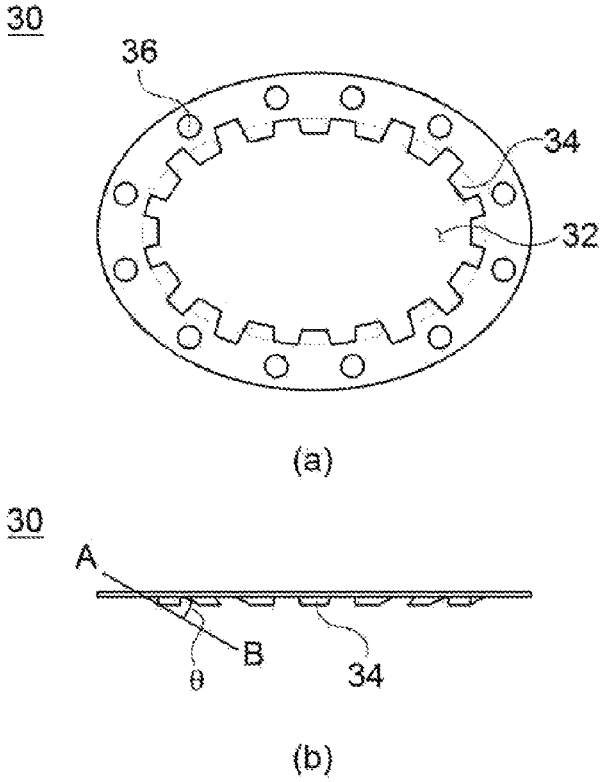
FIG. 4 provides diagrams illustrating a shape of a locking washer according to an exemplary embodiment of the present disclosure.

Referring to FIG. 1 to FIG. 2 and FIG. 4, the locking washer 30 may include the second connection hole 32, the protrusions 34, and the combination holes 36.

The locking washer 30 may be formed of stainless steel. The stainless steel is relatively less worn out than mild steel and thus can be used for a long time. For example, the locking washer 30 may be formed of stainless steel 201 among various kinds of stainless steel. Further, the locking washer 30 may be manufactured by processing portions in contact with the upper body part 30 and the lower body part 40 with a material which is not easily slippery. For example, the contact portions may be formed of a non-slip material. Moreover, portions of the upper body part 20 and the lower body part 40 in contact with the locking washer 30 may also be formed of such a material.

As illustrated in FIG. 4A, the second connection hole 32 may be formed at the center of the locking washer 30. The second connection hole 32 may be positioned corresponding to a position of the first connection hole 22. That is, the second connection hole 32 may be provided as communicating with the first connection hole 22. Therefore, a diameter of the second connection hole 32 may be equal to a diameter of the first connection hole 22. Further, the second connection hole 32 may be formed so as to correspond in shape to the first connection hole 22. Therefore, the second connection hole 32 may have a cross section formed into an oval shape. Furthermore, the lower body part 30 may be forcibly inserted into the second connection hole 32.

In the locking washer 30, a plurality of combination holes 36 for combination with the combination protrusions 26 may be formed at positions corresponding to the combination protrusions 26, respectively. The combination protrusions 26 of the upper body part 20 may be inserted and combined with combination holes 36. Therefore, the locking washer 30 may be inserted and combined with the upper body part 20.

Further, on the locking washer 30, a plurality of protrusions 34 extended inwardly along an inner periphery of the second connection hole 32 may be provided. The protrusions 34 may be formed so as to face each other and a space may be formed therebetween. The protrusions 34 may be formed apart from each other with a predetermined gap. Since the protrusions 34 are formed consecutively, the space is formed between them, so that the protrusion 34 and the space are formed repeatedly. The space is formed, the forcible insertion of the lower body part 40 may be easily performed.

As illustrated in FIG. 4B, the protrusions 34 are slanted upwardly or downwardly at a predetermined angle θ with respect to the second connection hole 32. That is, the protrusions 34 may be slanted from a side A toward a side B at the predetermined angle θ. Herein, the side A may refer to a side on which the combination holes 36 are positioned, and the side B may refer to a side opposite thereto. Herein, the predetermined angle θ may be from 25 degrees to 35 degrees. For example, if the protrusions 34 have an angle of 25 degrees of less, a force applied by the protrusions 34 to the lower body part 40 may be decreased. Accordingly, a combination force between the locking washer 30 and the lower body part 40 may be decreased. Further, if the protrusions 34 have an angle of degrees or more, a relatively greater force may be required when the locking washer 30 and the lower body part 40 are combined, and it may be difficult to combine the locking washer 30 and the lower body part 40. Therefore, an optimal slant angle of the protrusions 34 may be 30 degrees.

Further, the number of the protrusions 34 may include at least one of 12, 16, or 20. For example, if the number of the protrusions 34 is 20, the combination force with the lower body part 40 may be increased. Herein, the protrusion 34 and the lower body part 40 are provided so as to be pressurized, so that the combination force between the protrusion 34 and the lower body part 40 can be further increased.

Furthermore, the protrusion 34 may have a cross section formed into a circular shape, a rectangular shape, or a polygonal shape. Since the protrusions 34 are in contact with a lower body main part 42 and slanted from the side A toward the side B, a force (i.e., pressure) applied to the lower body main part 42 is generated. Due to generation of the force, the protrusion 34 can be positioned as being stably fixed to the lower body main part 42. That is, the protrusions are forcibly inserted into the lower body main part 42, and, thus, the upper body part 20 and the lower body part 40 can be fixed and combined with each other.

Referring to FIG. 1 and FIG. 2 again, the lower body part 40 may include the lower body main part 42, the third connection hole 43, a lower body supporting part 44, and position fixing protrusions 46. The lower body main part 42 may be formed into a column shape so as to be forcibly inserted toward the second connection hole 32 of the locking washer 30. The lower body main part 42 and the lower body supporting part 44 may be formed as one body, and may have a hollow inner space in order for the body part 50 to be inserted. That is, the third connection hole 43 may be formed. The third connection hole 43 may be formed to have a diameter equal to or smaller than the diameter of the second connection hole 32 formed in the locking washer 30. This is to forcibly insert and fix the lower body main part 42 in the second connection hole 32. If the lower body main part 42 is forcibly inserted into the second connection hole 32, the protrusions 34 of the locking washer may be brought into direct contact with an outer surface of the lower body main part 42.

Further, when the lower body main part 42 is forcibly inserted, a stumbling sill (not illustrated) may be formed in order for the protrusions 34 to be caught. That is, a concave-convex shape may be formed on the outer surface of the lower body main part 42. That is, in order to increase a frictional force between the protrusions 34 and the lower body main part 42, a concave-convex shape may be formed on the outer surface of the lower body main part 42. The concave-convex shape may be formed as repetition of a groove and a protrusion, and the protrusions 34 may be fixed as being caught by the grooves formed in the lower body main part 42. Herein, the protrusions 34 may be provided so as to pressurize the lower body main part 42.

Figure 6:
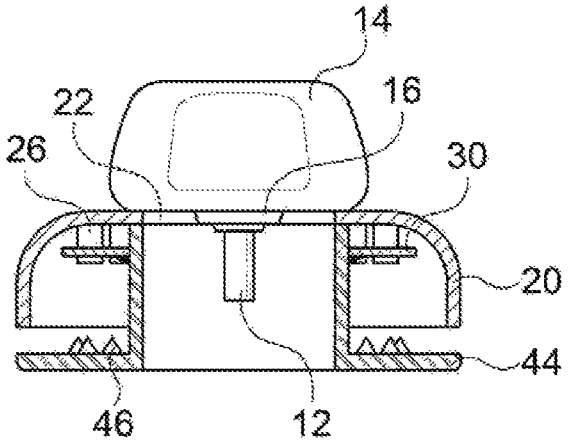
FIG. 6 provides diagrams illustrating the locking device combined in part according to an exemplary embodiment of the present disclosure.
Figure 6:
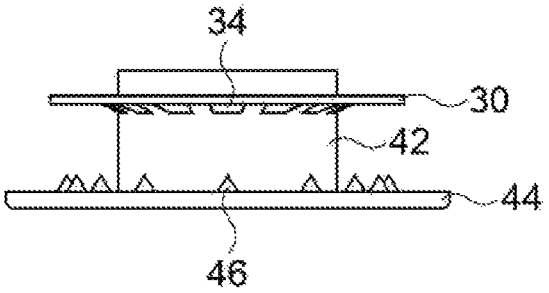

Meanwhile, the lower body supporting part 44 may be formed into a plate shape and may function to support the lower body main part 42. Further, on the lower body supporting part 44, the position fixing protrusions 46 may be formed. A plurality of the position fixing protrusions 46 may be formed around the lower body supporting part 44. Referring to FIG. 6, while the upper body part 20 and the lower body part 40 are combined with each other, there may be a gap between the upper body part 20 and the lower body part 40. The gap may be a contact portion between the position fixing protrusions 46 with a material of a bag (including, e.g., leather and fabric). That is, the position fixing protrusions 46 may be in contact with one surface of the material of the bag, and the position fixing protrusions 46 may have sharp ends. Thus, the position fixing protrusions 46 may penetrate the material and may be fixed in position.

Figure 5:
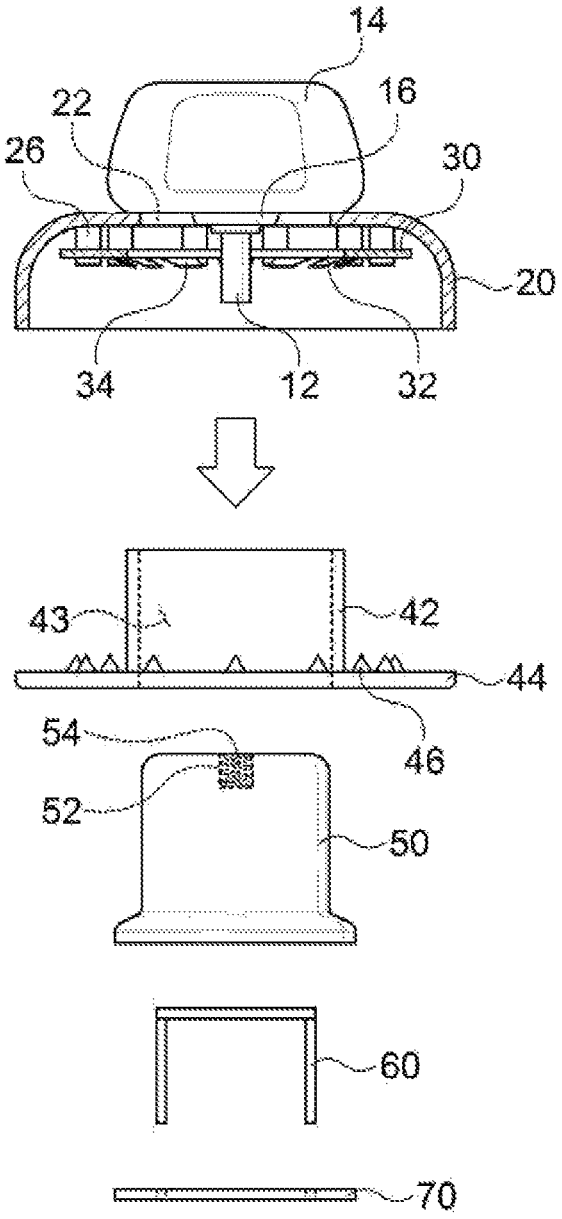
FIG. 5 provides diagrams illustrating the locking device combined in part according to an exemplary embodiment of the present disclosure.

FIG. 5 and FIG. 6 are partial combination views of the locking device 1 according to an exemplary embodiment of the present disclosure.

FIG. 5 provides diagrams illustrating the locking device 1 in which the locking washer 30 and the lower body part are combined with each other. The upper body part 20 and the locking washer 30 may be combined by inserting the combination protrusions 26 formed on the upper body part 20 into the combination holes 36 formed in the locking washer 30.

FIG. 6A illustrates that the lower body part 40 is combined with the upper body part 20 and the locking washer 30 combined as described above. FIG. 6B is a diagram illustrating that only the locking washer 30 and the lower body part 40 are combined with each other. Referring to FIG. 6A and FIG. 6B, the lower body part 40 may be combined with the upper body part 20 and the locking washer 30. To this end, the lower body part 40 may be forcibly inserted into the second connection hole 32 of the locking washer 30 and brought into close contact with the protrusions 34. If the lower body main part 42 is forcibly inserted into the second connection hole 32 of the locking washer 30, the lower body main part 42 can be forcibly inserted in close contact with the protrusions 34 from the moment when the protrusions 34 are in close contact with the outer surface of the lower body main part 42. Therefore, the lower body main part 42 may apply a forcible insertion force toward the protrusions 34. Further, when forcibly inserted into the second connection hole 32, the lower body main part 42 is forcibly inserted through linear movement. Thus, the forcible insertion force applied toward the protrusions 34 can be uniform. Therefore, a diameter is increased by the forcible insertion force uniformly applied to the locking washer 30, so that the protrusions 34 strongly pressurize the lower body main part 42. That is, when the lower body part 40 is forcibly inserted into the locking washer 30, the forcible insertion force may cause deformation, i.e., the increase in diameter, of the locking washer 30. Therefore, a combination force between the protrusion 34 and the lower body main part 42 may be increased so as to achieve strong combination.

Referring to FIG. 1 to FIG. 2 and FIG. 5 again, the body part 50 may have an open space therein. That is, the open space is configured to allow the first supporting plate 60 and the second supporting plate 70 to be inserted therein. The body part 50 may be inserted toward the upper body part 20 via the third connection hole 43 formed in the lower body part 40. That is, as illustrated in FIG. 3, the body part 50 may be at the same position as the upper body part 20, and may be a part in contact with the locking unit 10. Further, in the body part 50, the fourth connection hole 52 may be formed in order for the locking unit rotating rod 12 to be inserted. The locking unit rotating rod 12 may pass through the fourth connection hole 52 of the body part 50, so that the upper body part 20 and the body part 50 may be combined with each other. The fourth connection hole 52 may be formed so as to correspond in shape to the locking unit rotating rod 12.

The first supporting plate 60 may function to support the body part 50 toward the upper body part 20. That is, the first supporting plate 60 may be inserted and fixed in the body part 50. In the second supporting plate 70, at least one hole for combination with the first supporting plate 60 may be formed.

Figure 7:
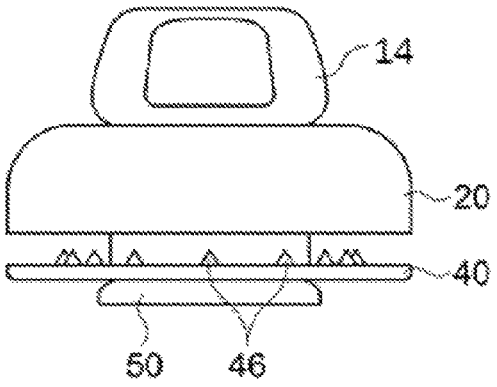
FIG. 7 is a diagram illustrating the combined locking device according to an exemplary embodiment of the present disclosure.

FIG. 7 is a diagram illustrating the combined locking device 1 according to an exemplary embodiment of the present disclosure. FIG. 7 illustrates that the above-described components of the locking device 1 are combined with each other.

The components of the locking device 1 according to an exemplary embodiment of the present disclosure have been described above. The locking device 1 configured as described above is operated as follows.

It is assumed that the locking device 1 is formed by combining the locking unit 10, the upper body part 20, the locking washer 30, the lower body part 40, the body part 50, the first supporting plate 60, and the second supporting plate 70 in order.

If the locking unit rotating part 14 is rotated clockwise or counterclockwise, the locking unit rotating rod 12 may be rotated accordingly while being applied with an elastic force of the elastic member 54 positioned within the body part 50. The locking unit rotating part 14 may be caught by the stumbling sill 24 formed on the upper body part 20, which means that a locking operation of the locking device 1 is performed. The stumbling sill 24 may be formed into a concave groove to suppress a deviation of the locking unit rotating part 14. Therefore, the locking unit rotating part 14 may not deviate from the stumbling sill 24 to maintain a locked state. Further, the locking device 1 can be strongly combined by the locking washer 30.

When an unlocking operation is performed, if the locking unit rotating part 14 is rotated clockwise or counterclockwise, the locking unit rotating part 14 may be applied with an elastic force of the elastic member 54 positioned within the body part 50. Accordingly, the locking unit rotating rod 12 may be rotated. Since the locking unit rotating part 14 satisfies the conditions for a deviation from the stumbling sill 24 formed on the upper body part 20, the locking may be canceled.

Figure 8:
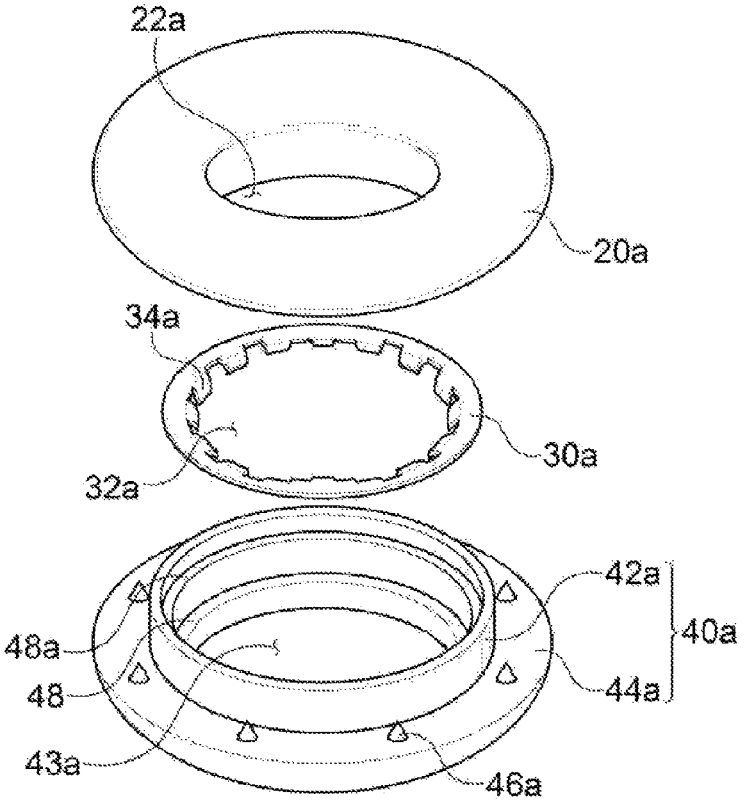
FIG. 8 is a partially exploded view of a locking device according to another exemplary embodiment of the present disclosure.

FIG. 8 is a partially exploded view of a locking device 1*a* according to another exemplary embodiment of the present disclosure.

Referring to FIG. 8, the locking device 1*a* may include an upper body part 20*a*, a locking washer 30*a*, and a lower body part 40*a*. A first connection hole 22*a* for combination may be formed at the center of the upper body part 20*a*. The locking washer 30 may include a second connection hole 32*a* and protrusions 34*a*. The lower body part 40*a* may include a lower body main part 42*a*, a lower body supporting part 44*a*, a third connection hole 43*a*, position fixing protrusions 46*a*, a first step 48, and a second step 48*a*.

As illustrated in FIG. 8, in order to combine the lower body part 40*a* and the locking washer 30*a* with each other, the first step 48 and the second step 48*a* may be formed on the lower body part 40*a*. The locking washer 30*a* may be forcibly inserted between the first step 48 and the second step 48*a* and fixed at that position. Accordingly, the locking washer 30*a* may be combined with the upper body part 20*a* in a state where the locking washer 30*a* is fixed to the lower body part 40*a*. Therefore, on the upper body part 20*a*, combination protrusions (not illustrated) may be formed.

While the representative embodiments of the present disclosure have been described in detail, it should be understood by a person having ordinary skill in the art that various modifications may be made therein without departing from the scope of the present disclosure. Therefore, the scope of the present disclosure is not limited to the embodiments described above but should be defined by the following claims and equivalents thereof.

What is claimed is:

1. A locking device comprising:

a locking unit capable of performing locking and unlocking operations by rotation;

an upper body part in which a first connection hole is formed;

a body part which is inserted into the first connection hole of the upper body part and combined with one end of the locking unit;

a lower body part in which a third connection hole into which the body part is inserted from below is formed; and a locking washer which is positioned between the upper body part and the lower body part and configured to fix and combine the upper body part and the lower body part, wherein in the locking washer, a second connection hole is formed, and a plurality of protrusions extended inwardly along an inner periphery of the second connection hole is provided.

2. The locking device according to claim 1, wherein the upper body part includes a plurality of combination protrusions formed on a lower side of the upper body part.

3. The locking device according to claim 2, wherein the locking washer includes combination holes for combination with the combination protrusions at positions corresponding to the combination protrusions, respectively.

4. The locking device according to claim 1, wherein the number of the protrusions includes at least one of 12, 16, or 20.

5. The locking device according to claim 1, wherein the protrusions are slanted upwardly or downwardly at a predetermined angle, and the protrusions are forcibly inserted into the lower body part, and, thus, the upper body part and the lower body part are fixed and combined with each other.

6. The locking device according to claim 5, wherein the angle is from 25 degrees to 35 degrees.

7. The locking device according to claim 1, wherein the protrusion has a cross section formed into a circular shape, a rectangular shape, or a polygonal shape.

* * * * *